United States Patent [19]

Schiferli

[11] 4,075,844

[45] Feb. 28, 1978

[54] HOT-GAS RECIPROCATING ENGINE HAVING CONTROLLED COUPLING OF A COMBUSTION AIR FAN

[75] Inventor: Johannes W. Schiferli, Eindhoven, Netherlands

[73] Assignee: U.S. Philips Corporation, New York, N.Y.

[21] Appl. No.: 696,426

[22] Filed: Jun. 15, 1976

[30] Foreign Application Priority Data

Jul. 7, 1975 Netherlands ..... 7508053

[51] Int. Cl.[2] ..... F02G 1/06

[52] U.S. Cl. ..... 60/524; 192/82 T

[58] Field of Search ..... 60/517, 524; 192/82 T

[56] References Cited

U.S. PATENT DOCUMENTS 3,859,794 1/1975 Hakansson ..... 60/524

FOREIGN PATENT DOCUMENTS 1,281,142 7/1972 United Kingdom ..... 60/517

*Primary Examiner*—Allen M. Ostrager
*Assistant Examiner*—Stephen F. Husar
*Attorney, Agent, or Firm*—Frank R. Trifari; David R. Treacy

[57] ABSTRACT

A hot-gas reciprocating engine whose shaft is coupled to the combustion air fan via sucessively a variable transmission, constructed as a slip coupling whose degree of slip is inversely proportional to the temperature of the heater, and a fixed transmission.

3 Claims, 2 Drawing Figures

HOT-GAS RECIPROCATING ENGINE HAVING CONTROLLED COUPLING OF A COMBUSTION AIR FAN

The invention relates to a hot-gas reciprocating engine comprising at least one working space in which a working medium performs a thermodynamic cycle, heat originating from a burner device being applied to the working medium via a heater, the engine further comprising a fan which is coupled to a shaft of the engine and which serves to supply combustion air to the burner device A variable transmission couples the fan to the engine shaft. The transmission has an input shaft which is coupled to the engine shaft and an output shaft which is coupled to the fan shaft, the transmission ratio of the variable transmission being influenced by a control signal which represents an engine parameter.

A hot-gas reciprocating engine of the kind set forth in known from the Dutch patent application No. 6611690 laid open to public inspection, to which U.S. Pat. No. 3,399,526 corresponds.

In the known hot-gas reciprocating engine a rigid and a slidable conical pulley are provided on the input shaft as well as on the output shaft of the variable transmission, the pulleys of the two shafts being coupled by a belt. The transmission ratio of this pulley/belt transmission is determined by the engine speed as well as by the mean working medium pressure prevailing in the engine.

This construction has a drawback in that only comparatively small transmission ratios are feasible, because slip of the belt with respect to the conical pulley occurs beyond a given belt speed. In order to obtain the desired large quantity of combustion air for comparatively high powers, special structural steps can be taken to prevent the slip. However, the construction will then be heavey, large and expensive.

Moreover, the control of the applied quantity of combustion air depending on the engine speed and the mean working medium pressure is incomplete in that the heater temperature is not taken into account. When the output power of the engine is reduced by a decrease of the working medium pressure level in the engine, the reduction of the quantity of combustion air applied lags the pressure reduction due to the inertia of the combustion air control system. The temperature of the heater can thus rise to an impermissable level. In order to prevent excessive temperature, additional steps must be taken to reduce the applied quantity of combustion air (and fuel) directly in reaction to the heater temperature, for example, by means of a choke valve in the combustion air inlet of the burner device.

The invention has for its object to provide an improved hot-gas reciprocating engine of the kind set forth, in which the desired quantity of combustion air is always applied in a simple and reliable manner from the lowest to the desired high fan speed, without risk of overheating of the heater.

According to the invention a transmission having a fixed transmission ratio is provided between the output shaft the fan shaft, the variable transmission being constructed as a slip coupling, the degree of slip thereof being inversely proportional to the heater temperature, detected by a temperature sensor, as the engine parameter. The temperature sensor may be, for example, a measuring instrument which comprises a thermocouple and which varies the supply of combustion air if the heater temperature deviates from the desired value due to variations of the engine power.

In a preferred embodiment of the hot-gas reciprocating engine in accordance with the invention the slip coupling, constructed as a spring-loaded plate coupling, is controlled by means of a pressurized medium in a duct system, the temperature sensor actuating a pressure control member included in the duct system in order to control the medium control pressure.

The pressurized medium may be a liquid or a gas.

The duct system preferably forms part of the lubricating oil system of the engine, so that existing pressurized media are utilized to good advantage.

The invention will be described in detail hereinafter with reference to the drawing which is diagrammatic and not to scale.

Figure 1:
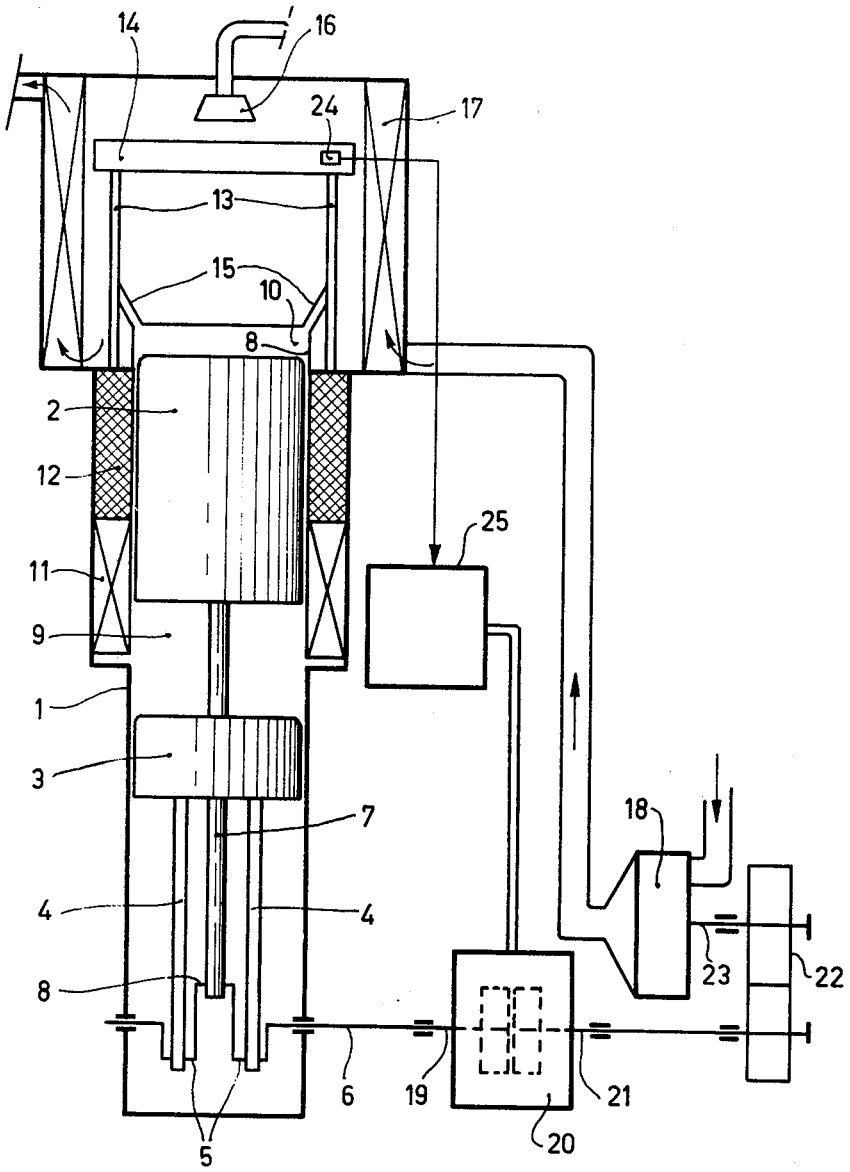
FIG. 1 is a longitudinal sectional view of a hot-gas engine whose crank shaft is coupled to the shaft of a combustion air fan via a slip coupling which is influenced by a control signal originating from a heater temperature sensor, and also via a transmission having a fixed transmission ratio.

The reference 1 in FIG. 1 denotes a cylinder of a hot-gas reciprocating engine in which a displacer 2 and a piston 3 can reciprocate at a phase difference with respect to each other. The piston 3 comprises two piston rods 4, each of which is connected to a crank 5 of a crank shaft 6. A displacer rod 7, connected to the displacer 2 and passed through the piston, is connected to a crank 28 of the crank shaft 6.

The upper end of the cylinder 1 is formed by a cylinder head 8. The compression space 9 communicates with the expansion space 10 of the engine via a cooler 11, a regenerator 12, a set of heater pipes 13, communicating with an annular duct 14, and a set of pipes 15 which extend between the annular duct and the expansion space 10. The heater pipes enclose a combustion space in which a burner 16 is arranged to which fuel oil is applied in a manner not shown, for example by means of a pumping device and a control valve which is arranged in front of the burner 16 and which is operated by a control signal derived from the heater temperature. Around the combustion space there is provided a heat exchanger 17 to which combustion air is applied by means of a fan 18 and which the combustion gases are discharged. The crank shaft 6 is coupled to the input shaft 19 of a slip coupling 20 which is shown schematically and whose output shaft 21 is coupled, via a transmission 22 having a fixed transmission ratio, for example 1:5, to the fan shaft 23. The transmission 22 is preferably a belt/pulley transmission which, because no variable pulleys are required, can be readily constructed to be slip-free. Obviously, other transmissions are also feasible; for example, a gearwheel transmission which, however, has the drawback that it produces noise.

Figure 2:
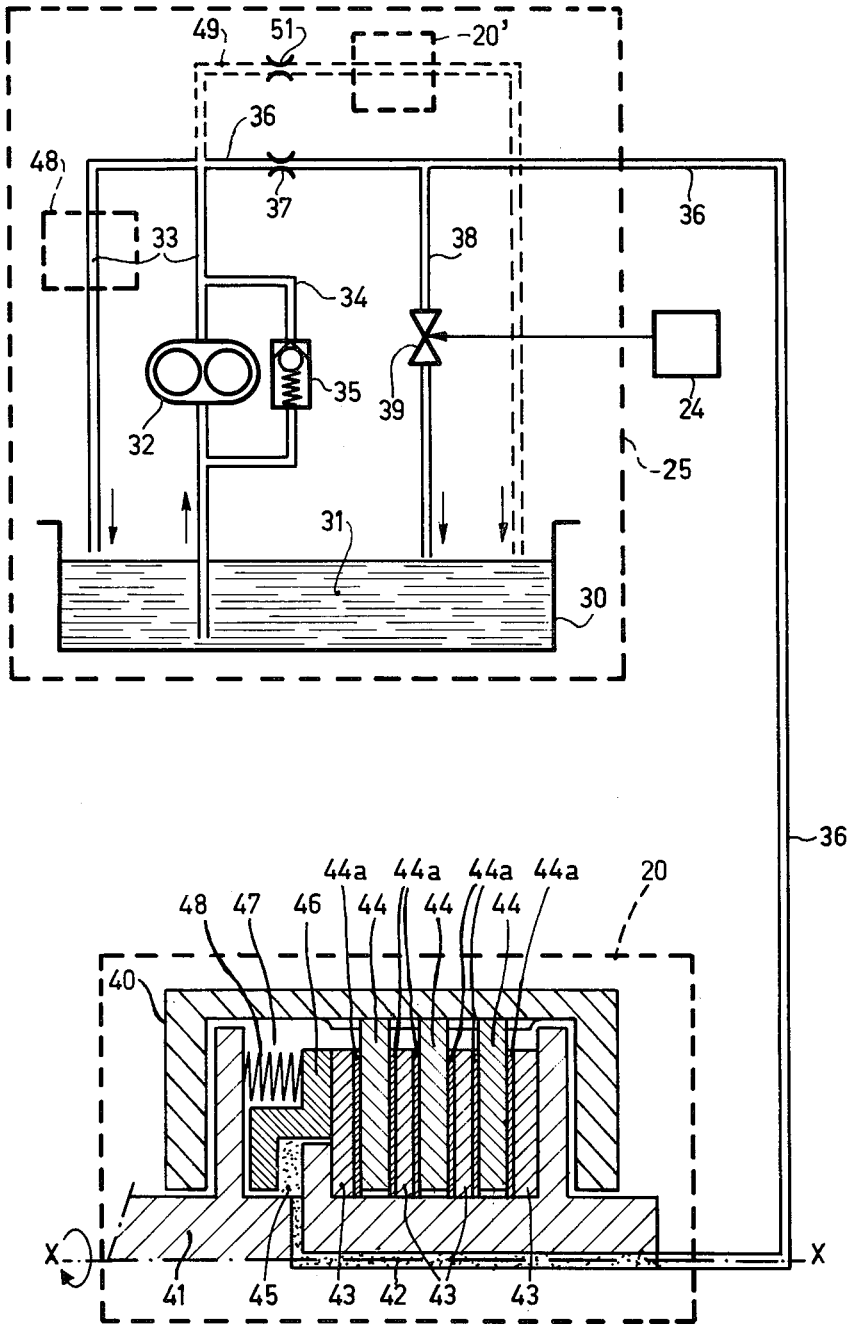
FIG. 2 is a longitudinal sectional view of one half of an embodiment of a slip coupling and an embodiment of a control system for this coupling.

The annular duct 14 of the heater 13, 14, 15 includes a temperature sensor 24, for example, a thermocouple which supplies an electrical signal which represents the actual heater temperature. When this signal is compared with a constant electrical signal which corresponds to the desired heater temperature, a positive or negative difference signal is obtained which is applied, possibly after amplification in an electronic differential amplifier, to a control system 25 which in its turn controls the degree of slip of the slip coupling 20. FIG. 2 yet to be described shows an embodiment of the control system 25 and also an embodiment of the slip coupling 20.

The assembly is constructed so that, when the heater temperature rises higher than the desired value (which occurs in the case of a sudden reduction of the engine power by a reduction of the mean working medium pressure in the engine and/or by a reduction of the engine speed), the slip coupling 20 starts to slip more, so that the overall transmission ratio between the crank shaft 6 and the fan shaft 23 decreases. The fan 18 then starts to rotate at a lower speed, thus delivering less combustion air. Obviously, the quantity of fuel applied to the burner 16 is reduced at the same time. Conversely, should the heater temperature tend to decrease below the desired value, less slip of the slip coupling 20 occurs and the fan 18 starts to rotate at a higher speed, so that more combustion air is delivered. Moreover, the fuel control system at the same time starts to supply more fuel.

The embodiment of the control system 25 of FIG. 1 which is shown in FIG. 2 comprises a reservoir 30 containing oil 31. An oil pump 32 pumps oil from the reservoir 30 through a duct 33, from which the oil returns to the reservoir 30 again. An auxiliary duct 34 includes a spring-loaded non-return valve 35. The non-return valve 35 keeps the oil pressure on the delivery side of the oil pump 32 constant. The duct 33 has connected to it a branch duct 36 which includes a restriction 37 which limits the oil flow through the duct 36 in order to prevent reduction of the oil pressure in the duct 33 to a dangerous level. The branch duct 36 is connected to an embodiment of the slip coupling 20 of FIG. 1 and to a return duct 38 which opens into the reservoir 30. The return duct 38 includes a control valve 39 which is controlled by the difference signal originating from the temperature sensor (FIG. 1). When the heater temperature increases, the passage of the control valve 39 is reduced, so that oil pressure in the branch duct 36 increases; while in the event of decreasing heater temperature, the control valve is opened further, so that the oil pressure level in the branch duct 36 decreases.

The embodiment of the slip coupling 20 comprises a rotating housing 40 which is coupled to the fixed transmission 22 (FIG. 1) and an input shaft 41 which is coupled to the crank shaft 6 (FIG. 1). The branch duct 36 is connected to a duct 42 in the input shaft 41. Because the slip coupling is rotation-symmetrical, except for the duct 42, only the portion above the center line X-X, which is the rotary axis of the shaft 41 and the housing 40, is shown.

The shaft 41 has an even number of plates 43 which rotate as the shaft rotates, but which are slidable axially a small amount with respect to the shaft.

The housing 40 has an odd number of internal plates 44 which rotate as the housing rotates, and are also slidable axially a small amount with respect to the housing. The plates 44 are provided on both sides with friction material **44*a***.

The duct 42 in the shaft 41 communicates with an annular chamber 45 formed by the shaft 41 and a pressure plate 46. Via the branch duct 36 oil originating from the control system 25 can be applied to this chamber. An outer annular space 47 between the shaft 41 and the plate 46 accommodates a compression spring 48 which exerts an axial force on the assembly formed by the plate 46 and the plates 43 and 44 pressing the plate 43 against the friction linings **44*a* of the plates 44. The pressurized oil in the chamber 45 exerts a force opposing the axial force of the spring 48**.

When the heater temperature has been adjusted to the desired value, the interaction between the compression spring 48 and the oil in the chamber 45 is such that a given slip exists between the rotating plates 43 and 44, which corresponds to a given transmission ratio of the slip coupling.

If the heater temperature starts to increase because the engine power to be delivered decreases, the temperature sensor 24 causes the control valve 39 to be closed further, with the result that the oil pressure in the branch duct 36 and hence in the chamber 45 increases. The surface pressure between the plates 43 and 44 decreases, with the result that the coupling can transmit less power and the slip between the plates 43 and 44 increases. Consequently, the transmission ratio of the slip coupling decreases. The ultimate result is that the speed of the fan 18 (FIG. 1) decreases, so that less combustion air and, obviously, less fuel is applied to the engine.

Conversely, if the heater temperature tends to decrease below the desired temperature, due to an increase in the required engine power, the control valve 39 is opened further by the temperature sensor 24. An oil pressure drop then occurs in the branch duct 36 and hence in the chamber 45. The axial force caused by the spring loading then starts to prevail, and the surface pressure between the plates 43 and 44 increases, so that the slip coupling can transmit more power and the slip between the plates 43 and 44 decreases. The fan speed then increases and more combustion air is applied to the engine.

At the maximum quantity of combustion air or fuel required, the plates 43 and 44 are fully coupled and the transmission ratio of the slip coupling is 1 : 1. At smaller quantities of combustion air or fuel, the transmission ratio is $1 : x$, where $x < 1$.

In order to dissipate the released friction heat, grooves can be provided in the plates 43. Cooling medium can circulate through these grooves and the unused spaces formed by the shaft 41 and the housing 40. This is not shown in the drawing for the sake of simplicity.

Preferably, use is made as much as possible of auxiliaries already present. To this end, the crank case of the hot-gas reciprocating engine can be used as the reservoir 30 of the control system 25, while the duct 33 with the pump 32 can be port of the lubricating oil system in which the engine parts to be lubricated are denoted together by the reference 48. Moreover, the slip coupling can be cooled by using lubricating oil as the cooling medium. To accomplish this, a branch duct 49 is connected to the duct 33, and oil is passed through the slip coupling, denoted by the reference 20', and is subsequently returned to the reservoir 30. In order to limit this oil flow, a restriction 51 is included in the duct 49.

What is claimed is:

1. A hot-gas reciprocating engine, comprising at least one working space in which a working medium performs a thermodynamic cycle, a burner device, a heater for applying heat from the burner to the working medium, a fan on a fan shaft for applying combustion air to the burner device, and a variable transmission coupling a shaft of the engine to the fan, the transmission including an input shaft coupled to the engine shaft and an output shaft coupled to the fan shaft, the transmission ratio of said variable transmission being influenced by a control signal which represents an engine parameter, wherein between the output shaft to the variable transmission and the fan shaft a transmission having a fixed transmission ratio is coupled, the variable transmission is constructed as a slip coupling, and the engine comprises means for maintaining the degree of slip of the slip coupling inversely proportional to the heater temperature, said means including a temperature sensor for sensing temperature as the engine parameter.

2. A hot-gas reciprocating engine as claimed in claim 1, wherein the slip coupling is constructed as a spring-loaded plate coupling and said means comprises a pressurized medium in a duct system for controlling slip coupling pressure, the temperature sensor actuating a pressure control member included in the duct system in order to control the medium control pressure.

3. A hot-gas reciprocating engine as claimed in claim 2, wherein the duct system forms part of a lubricating oil system of the engine.

* * * * *

UNITED STATES PATENT AND TRADEMARK OFFICE

CERTIFICATE OF CORRECTION

PATENT NO. : 4,075,844

DATED : February 28, 1978

INVENTOR(S) : JOHANNES W. SCHIFERLI

It is certified that error appears in the above-identified patent and that said Letters Patent are hereby corrected as shown below:

Col. 1, line 37, "heavey" should be --heavy--

Col. 2, line 48, after "18 and" insert --from--

Col. 4, line 49 after "32 can be", "port" should be --part--

Claim 1, line 12, (Col. 5, line 2) after "shaft", "to" should be --of--

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*